US011933198B2

(12) United States Patent
Heirman

(10) Patent No.: US 11,933,198 B2
(45) Date of Patent: Mar. 19, 2024

(54) METHOD AND DEVICE FOR EXPANDING A FLUID

(71) Applicant: ATLAS COPCO AIRPOWER, NAAMLOZE VENNOOTSCHAP, Wilrijk (BE)

(72) Inventor: Peter Jozef Heirman, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/042,391

(22) PCT Filed: Sep. 13, 2021

(86) PCT No.: PCT/IB2021/058302
§ 371 (c)(1),
(2) Date: Feb. 21, 2023

(87) PCT Pub. No.: WO2022/064321
PCT Pub. Date: Mar. 31, 2022

(65) Prior Publication Data

US 2023/0323795 A1 Oct. 12, 2023

(30) Foreign Application Priority Data

Sep. 24, 2020 (BE) ..... 2020/5659

(51) Int. Cl.
*F01K 7/04* (2006.01)
*F01K 13/02* (2006.01)

(52) U.S. Cl.
CPC ..... *F01K 7/04* (2013.01); *F01K 13/02* (2013.01)

(58) Field of Classification Search
CPC ... F01K 7/04; F01K 13/02; F01K 7/02; F01K 25/08; F01K 27/00; F17D 1/04
See application file for complete search history.

(56) References Cited

FOREIGN PATENT DOCUMENTS

| | | | |
|---|---|---|---|
| CN | 107575744 A | * | 1/2018 |
| CN | 207599346 U | | 7/2018 |
| CN | 107575744 B | | 11/2019 |
| KR | 10-2018-0017752 A | | 2/2018 |

OTHER PUBLICATIONS

Machine Translation of CN-107575744-A (Year: 2018).*
Belgian Search Report for BE 202005659 dated May 17, 2021.
International Search Report for PCT/IB2021/058302 dated Nov. 18, 2021.
Written Opinion for PCT/IB2021/058302 dated Nov. 18, 2021.

* cited by examiner

*Primary Examiner* — Brandon D Lee
(74) *Attorney, Agent, or Firm* — Sughrue Mion, PLLC

(57) ABSTRACT

Device for expanding a fluid, which device (1) comprises an inlet (2) for a high pressure fluid, an outlet (3) for a low pressure fluid, and a control valve (4) between the aforementioned inlet (2) and outlet (3) for expanding the fluid to a predefined pressure level, characterized in that the device (1) is further provided with one or more expanders (5) for expanding the fluid, of which one or more expanders (5) are connected in parallel with the control valve (4), whereby the device (1) is provided with a controller (8) configured to control the expanders (5) based on a flow rate (Qklep) of the fluid through the control valve (4).

10 Claims, 5 Drawing Sheets

METHOD AND DEVICE FOR EXPANDING A FLUID

CROSS REFERENCE TO RELATED APPLICATIONS

Figure 1:
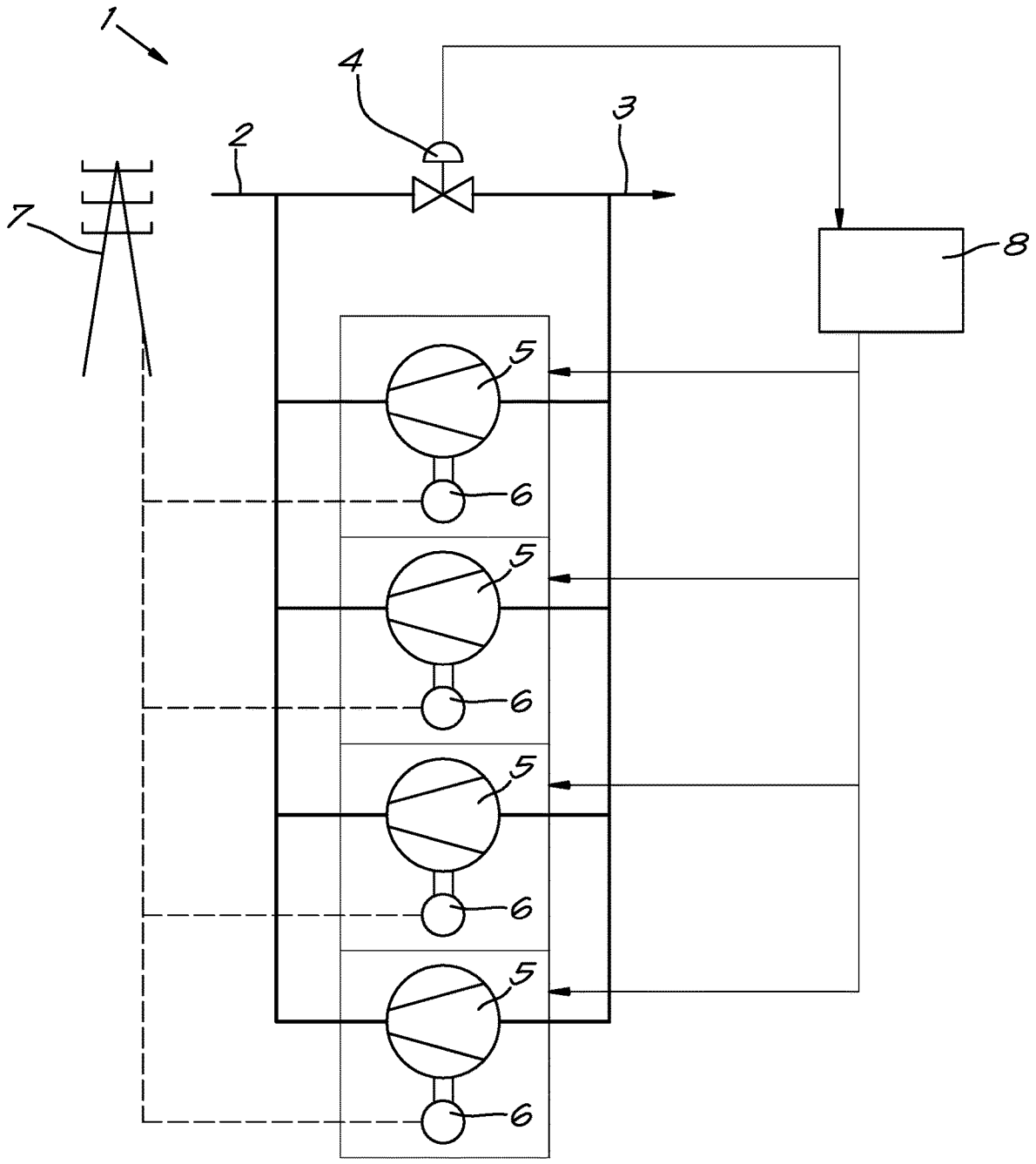

This application is a National Stage of International Application No. PCT/IB2021/058302 filed Sep. 13, 2021, claiming priority based on Belgian Patent Application No. 2020/5659 filed Sep. 24, 2020.

This invention relates to a method/device for expanding a fluid.

More specifically, the invention is intended for expanding a gas, such as natural gas for example, or for expanding vapor, whether or not superheated, saturated or supersaturated, such as steam for example.

Expanding means to bring the fluid from a high pressure to a low pressure.

It is known that in such device, an attempt is made to obtain a predefined pressure level for the low pressure, such as, for example, a constant low pressure or a low pressure within a limited constant interval of low pressures, independent of the flow rate.

Methods are already known to achieve this, which use a pressure-controlled valve, a so-called governor valve, which regulates the flow rate in a pressure-controlled manner.

This leads to a very robust and reliable low pressure control to the predefined pressure level.

An alternative method is to expand the gas using an energy-producing expansion device, or so-called 'expander', as described in CN 107 575 744 B, CN 207 599 346 U or KR 2018 0017752 A. Such an expander exploits the energy difference of the fluid between the high pressure and the low pressure to decrease the enthalpy of the fluid and convert it into another form of energy, such as rotational energy of a shaft.

This is known from power plants, for example, where steam at high pressure and temperature is used to drive an expander which in turn drives a generator.

Despite the advantage of energy production from an expander, in many cases a governor valve is still used, since in these cases a very high degree of certainty is required that the low pressure is controlled at the predefined pressure level in all circumstances and that under no circumstances excessive pressure can occur downstream of the device.

Such stringent requirements are typically the case in natural gas distribution, wherein very strict regulations must be met so that the use of an expander as a pressure regulating device is difficult or not approved.

Thus, in these situations, it is not possible to generate energy during the expansion of the natural gas.

This invention aims at solving at least one of the aforementioned and other disadvantages.

This invention has as its object a device for expanding a fluid, which device comprises an inlet for a fluid at high pressure and an outlet for a fluid at low pressure and a control valve between the aforementioned inlet and outlet for expanding the fluid to a predefined pressure level, characterized in that the device is further provided with one or more expanders for expanding the fluid, which are connected in parallel with the control valve, wherein the device is provided with a controller configured to control the expanders based on a flow rate of the fluid through the control valve.

"An inlet for a high pressure fluid and an outlet for a low pressure fluid" in this context means that a fluid at the inlet is at a higher pressure than a fluid at the outlet, or in other words, that a fluid at the outlet is at a lower pressure than a fluid at the inlet.

An advantage is that with such a device reliable pressure control is obtained, since the control valve will still determine the pressure of the fluid at the outlet, while energy can still be produced with a part of the flow rate of the fluid.

In other words, a very reliable pressure control will be able to be realized with the device while still allowing for energy production.

Since the pressure control is not realized via the expanders, they do not have to meet stringent requirements, but can use the already existing and extensively tested control valves for pressure control.

Preferably, means are provided to regulate the flow rate of the expanders.

These means may include, for example, a valve.

In a practical embodiment, these are one or more of the aforementioned expanders of the type whose flow rate passing through them can be regulated, or so-called expanders with flow control.

In another practical embodiment, these are one or more of the aforementioned expanders of the type whose flow rate passing through them cannot be regulated, or so-called on/off expanders.

A combination of one or more expanders with flow control and one or more on/off expanders in the same device according to the invention is also possible.

The invention also relates to a method for expanding a fluid by means of a device comprising an inlet for a high pressure fluid and an outlet for a low pressure fluid, a control valve between the aforementioned inlet and outlet for expanding the fluid and one or more expanders connected in parallel with the control valve, characterized in that the method consists of, on the one hand, controlling a flow rate of the fluid passing through the control valve such that a pressure at the aforementioned outlet is regulated at a predefined pressure level and, on the other hand, controlling a flow rate of the fluid passing through the expanders on the basis of the flow rate passing through the control valve.

Clearly, the benefits of such a method are analogous to the aforementioned benefits of the device.

Preferably, the method includes a means for determining the flow rate through the control valve.

In a preferred embodiment, the position of the control valve is used to determine the flow rate through the control valve.

This has the advantage that no flow meter needs to be provided, since for the control valve a relationship can be established between the position of the valve and the flow rate passing through it.

This is particularly beneficial when an existing device for expanding a fluid is expanded to include one or more expanders and there is not enough space in the existing device to install a flow meter.

Of course, it is also possible to calculate the flow rate through the control valve based on the total flow rate and the known or calculated flow rate of each expander in operation.

In a practical embodiment, the aforementioned expanders are of the type whose flow rate passing through them cannot be regulated and, in order to regulate the flow rate passing through the expanders, the method consists of the following steps:

- if the flow rate through the control valve is equal to or greater than Qmin+Qdelta+Qi and not all expanders are switched on yet, switch on an expander with flow rate Qi;

if the flow rate through the control valve becomes less than Qmin and not all expanders have been switched off yet, turn off an expander;

where:

Qmin is a maximum value of a total flow rate of fluid through the device under which only fluid may flow through the control valve and fluid may not flow through any expander, such as for control reasons of the control valve or for safety reasons;

Qdelta is a hysteresis value that is chosen in function of fluctuation in the total flow rate of the fluid such that an expander is not constantly switched on and then off;

Qi is the flow rate that can flow through an expander.

Such a method has the consequence that the control or actuation of the expanders will depend entirely on the flow rate passing through the safety valve.

It is not necessary for the aforementioned expanders to have the same flow rate Qi, although this is, of course, possible.

If there are several expanders with different flow rates, the switching on of an expander is done in function of the flow rate of this expander.

In that case, more advanced control strategies are also possible to maximize the total amount of energy produced, such as switching off one or more expanders and switching on one larger expander that is more efficient.

In another practical embodiment, the aforementioned expanders are of the type whose flow rate passing through them can be regulated and that, in order to regulate the flow rate passing through the expanders, the method includes the step of regulating the flow rate of an expander according to a curve that represents an unambiguous relationship with the flow rate passing through the control valve.

So this can be considered a master/slave regulation.

The aforementioned curve does not have to be a linear curve, but can also be such that when the flow rate increases, most of this flow rate passes through the expander, while the flow rate passing through the control valve hardly increases at all.

Such an advanced control strategy not only maximizes the energy produced, but also ensures, for example, that the maintenance of all expanders can be done on the same day, one after the other.

As mentioned above, a combination of expanders with flow control and on/off expanders is also possible, combining both of the aforementioned methods or control strategies.

Figure 2A:
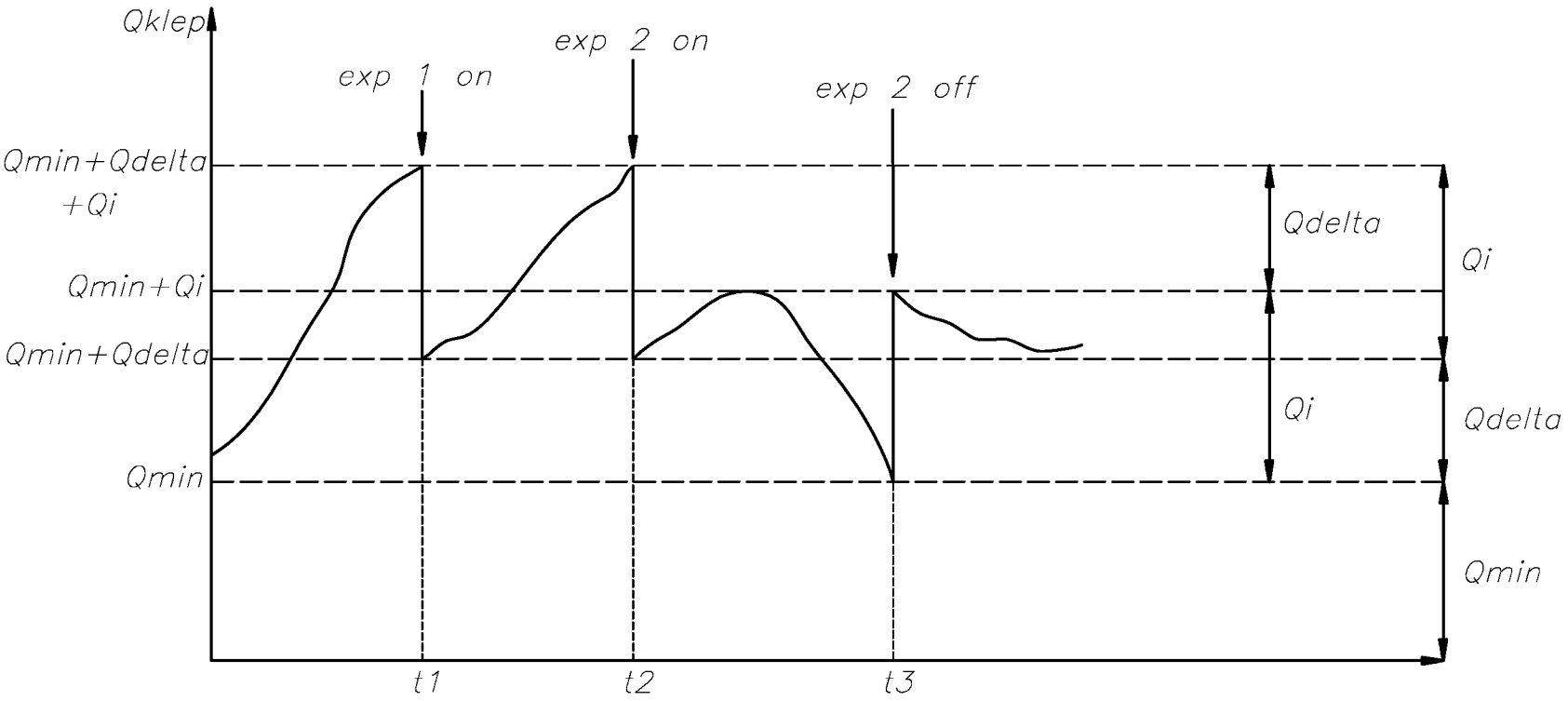
Figure 2B:
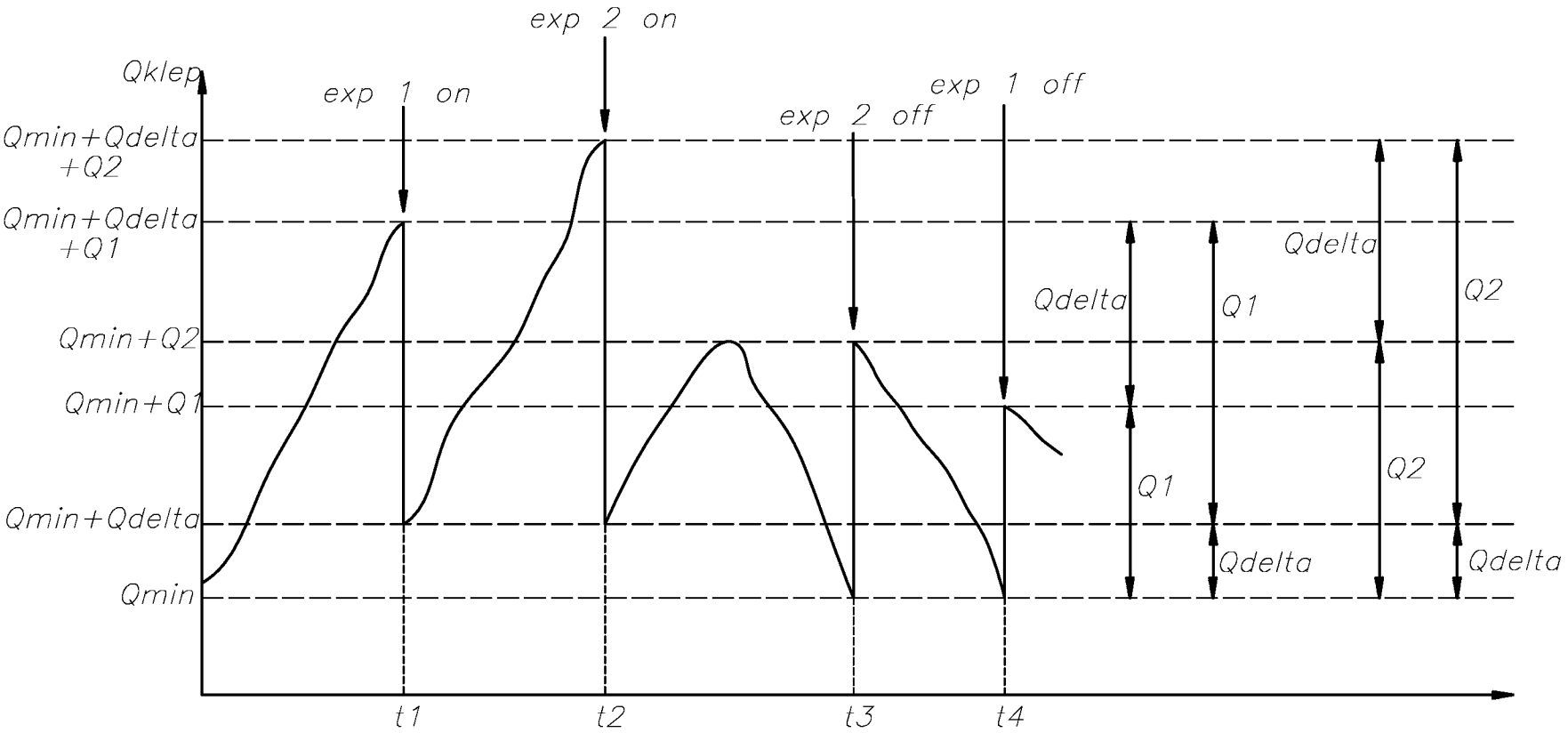
Figure 2C:
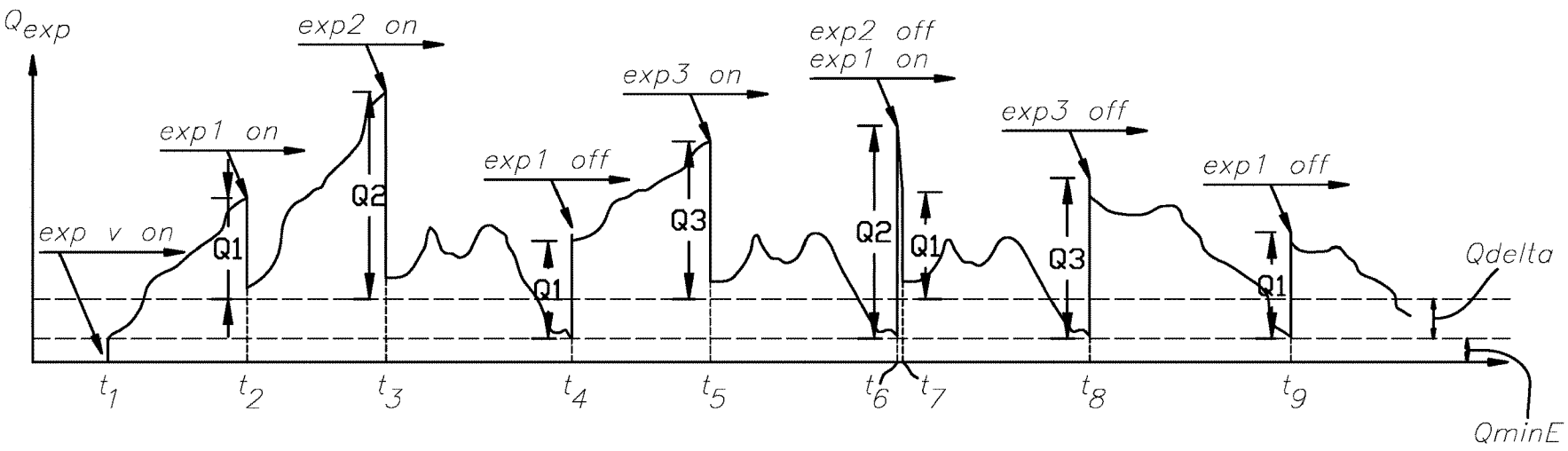
Figure 3:
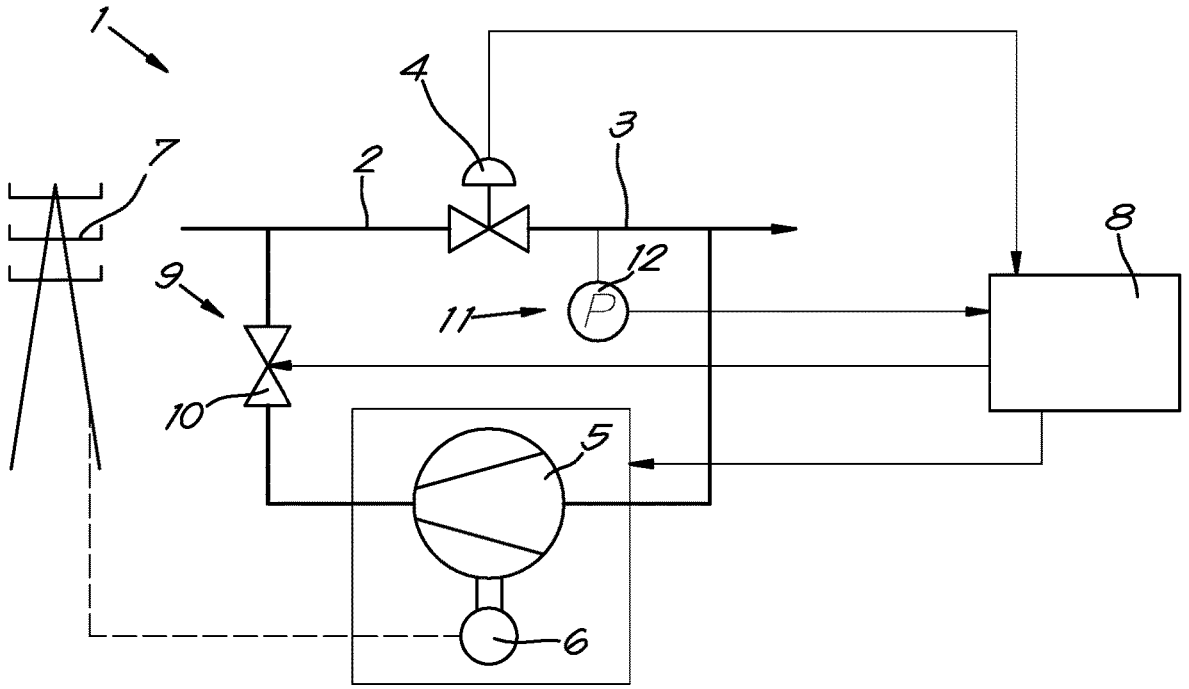

With a view to better demonstrating the characteristics of the invention, a number of preferred embodiments of a method and device based on the invention for expanding a fluid are described below, without any restrictive character, with reference to the accompanying drawings wherein:

FIG. 1 schematically shows an arrangement according to the invention;

FIGS. 2*a*, 2*b*, 2*c* schematically show different methods according to the invention;

FIG. 3 shows an alternative embodiment of FIG. 1.

The in FIG. 1 schematically shown device 1 for expanding a fluid includes an inlet 2 for a high pressure fluid and an outlet 3 for a low pressure fluid.

The aforementioned fluid in this example is natural gas, but the invention is not limited to this. Steam, air, hydrogen and other gases or vapors as well as mixtures thereof are also possible.

A control valve 4 is installed between the aforementioned inlet 2 and outlet 3, whereby control valve 4 will expand the fluid.

According to the invention, the device 1 is further provided with a number of expanders 5, in this case four, although, it is not excluded that this can be more or less than four expanders 5.

The expanders 5, like the control valve 4, will be able to expand the fluid. During this expansion, energy will be generated.

To this end, the expanders 5 in this case are each provided with a generator 6 which are connected to an electrical switchgear via a power grid 7.

The expanders 5 are all placed in parallel with the control valve 4.

In this case, but not necessarily the aforementioned expanders 5 are of the type whose flow rate Qi passing through them cannot be regulated.

Such expanders 5 are also called on/off expanders 5, and for such expanders 5, either no flow rate passes through them (in the off position of the expander 5) or a fixed flow rate Qi passes through them (in the on position of the expander 5).

According to the invention, a controller 8 is provided, which will control the expanders 5.

In practice, the signal from the controller 8 to an expander 5 will consist of several partial signals, for example, to a valve in the expander 5, to the electrical contactor of the generator 6, . . . . Of course, it is also possible that in addition to the expander 5 and the generator 6, other elements are provided, which are controllable by the controller 8.

The operation of the device 1 is very simple and as follows.

The operation is based on a method which is schematically shown in FIGS. 2*a*, 2*b*, 2*c*.

During the operation of the device 1, the flow rate Qklep passing through the control valve 4 is regulated such that the pressure at the aforementioned outlet 3 remains constant.

Such regulation is already known from the known devices.

Simultaneously to the regulation of the control valve 4, the method according to the inventions consists of regulating the flow rate Qi passing through the expanders 5 based on the flow rate Qklep passing through the control valve 4.

To this end, the method includes the step of determining the flow rate Qklep through the control valve 4.

For this purpose, the position of the control valve 4 is preferably used.

For example, by means of the position of the valve stem, i.e. how much the control valve 4 is opened. In this way, no flow meter is needed.

The determination of the flow rate Qklep through the control valve 4 can, if necessary, also be done using another measurement that is directly or indirectly an indication of the flow rate Qklep.

For example, by measuring the total flow rate passing through both the control valve 4 and the expanders 5 at either the inlet 2 or the outlet 3 and then subtracting the flow rate passing through the expanders 5. The control will then be done based on this calculated flow rate Qklep.

According to the invention, to control the flow rate passing through the expanders 5, the following steps can be performed:

if the flow rate Qklep through the control valve 4 is equal to or greater than Qmin+Qdelta+Qi and not all expanders 5 are switched on yet, switch on an expander 5 with flow rate Qi;

if the flow rate Qklep becomes smaller than Qmin and not all expanders 5 are switched off yet, switch off an expander 5;

where:

Qmin is a maximum value of a total flow rate of fluid through the device under which only fluid may flow through the control valve 4 and fluid may not flow through any expander 5, such as for control reasons of the control valve 4 or for safety reasons;

Qdelta is a hysteresis value that is chosen in function of fluctuation in the total flow rate of the fluid such that an expander 5 is not constantly switched on and then off;

Qi is the flow rate that can flow through an expander 5.

FIG. 2*a* shows such method schematically, for the case where all expanders 5 are on/off expanders 5 and have the same flow rate Qi.

FIG. 2*a* shows the progression of the flow rate Qklep through the control valve 4 over time.

At time t1, the flow rate Qklep increases to Qmin+Qdelta+Qi. An expander 5 is then switched on.

As a result, a flow rate Qi will flow through this expander 5. This expander 5 will now generate electrical energy.

The flow rate Qklep through the control valve 4 then decreases to Qmin+Qdelta, as shown in FIG. 2*a*.

Then, in the example of FIG. 2*a*, the flow rate continues to increase, so the flow rate Qklep continues to increase. After all, the flow rate through expander 5 is fixed at Qi.

At time t2, the flow rate Qklep has again increased to Qmin+Qdelta+Qi. An additional expander 5 is switched on, so that currently two expanders 5 are switched on and thus generating energy.

The flow rate Qklep through the control valve then decreases again to Qmin+Qdelta.

Then the flow rate decreases, causing the flow rate Qklep through the control valve 4 to decrease.

At time t3, the flow rate Qklep has decreased to Qmin. Since below this flow rate Qmin not all expanders that are switched on are allowed to work anymore, at this time one expander 5 is switched off causing the flow rate Qklep through the control valve to increase again to Qmin+Qi.

The order in which the expanders 5 are switched on and off is determined such that energy production is maximized and/or such that the number of running hours of the expanders 5 is optimized.

By using Qdelta, the expanders 5 are prevented from being switched on and off all the time, since a hysteresis margin is built in between the switch-on point and switch-off point.

If the control as explained above is done based on a calculated value for Qklep, Qmin (the maximum value of the total flow rate under which only fluid may flow through the control valve 4) will take into account inaccuracies of this measurement and calculation.

FIGS. 2*b* and 2*c* show similar situations for on/off expanders 5 with different constant flow rates, respectively, for a combination of expanders 5 with constant and adjustable flow rate.

In FIG. 2*b*, there are two expanders 5, one with a flow rate Q1 and one with a flow rate Q2, wherein at time t1 the first expander 5, with flow rate Q1 is switched on and then at time t2 the second expander, with flow rate Q2.

At time t3 and t4, the second expander 5 and the first expander 5 are switched off, respectively.

In FIG. 2*c*, there are four expanders 5, one with an adjustable flow rate 'EXv' and three with a fixed flow rate Q1, Q2, Q3.

FIG. 2*c* shows the progression of the flow rate Qexp through expander 5 with adjustable flow rate over time, wherein QminE is the minimum flow rate that should pass through the expander 5 with adjustable flow rate.

The figure shows that the different expanders 5 with fixed flow rate are switched on and off at different times. In function of this, the flow rate Qexp passing through the expander 5 with adjustable flow rate also changes.

There are several possible strategies for organizing the switching on and off of expanders 5:

Maximizing the flow rate through the expanders 5, so as to have as much energy production as possible;

Maximizing the specific energy production, i.e. energy per quantity of gas.

Optimizing the maintenance: by ensuring that all expanders 5 are used equally, it can be ensured that the maintenance of all expanders can be done one by one on the same day.

Minimizing the number of times the expanders 5 are switched on and off.

FIG. 3 shows a variant according to FIG. 1, wherein in this case only one expander 5 is provided, which is of the type whose flow rate passing through it can be regulated.

Further, this device 1 is provided with means 9 to seal the expander 5 such that fluid cannot reach the expander 5.

In this case, these means 9 are implemented in the form of a safety valve 10.

In the case of multiple expanders 5, it is of course not excluded that each expander 5 is provided with its own safety valve, i.e., that each safety valve 10 can close one specific expander 5.

Finally, the device 1 is preferably provided with means 11 for determining the pressure of the outlet 3, in this case this concerns a pressure sensor 12.

The method for controlling such device 1 is largely the same as explained above, only to control the flow rate passing through the expander 5, the method will now include the step of controlling the flow rate of the expander 5 according to a curve that displays an unambiguous relationship with the flow rate Qklep passing through the control valve 4.

This means that with each flow rate Qklep passing through the control valve 4, a corresponding value is associated with the flow rate passing through the expander 5.

The flow rate Qklep passing through the control valve 4 can either be measured with a flow meter, or, as mentioned above, determined based on the position of the control valve 4.

The aforementioned curve may be linear or non-linear, i.e., the ratio of the flow rate Qklep of the control valve 4 and the flow rate of the expander 5 may be fixed or may vary.

In a preferred variant, the curve is such that when the requested flow rate is higher (in order to keep the pressure at the outlet constant), the expander 5 will account for most of this additional flow rate, thus generating more energy, while the flow rate Qklep through the control valve 4 increases only slightly.

Controlling the flow rate through the expander 5 can be done in several ways. For example, by controlling the speed or inlet pressure of a volumetric expander 5, by controlling the so-called inlet guide vanes of a turbo-expander 5.

Preferably, the method includes the following step:

if the pressure at the outlet 3 rises above a maximum value pmax, the flow rate to the expanders 5 is shut off and all flow rate passes through the control valve 4.

This step is achieved, for example, by closing the safety valve 10.

In this way, an immediate response can be made to an excessive pressure rise. Although in the example shown in FIG. 1 the safety valve 10 is controlled by the controller 8, it is not excluded that a separate control unit is provided for this purpose.

Although the above always refers to one control valve 4, it is not excluded that the device 1 includes several control valves 4 connected in parallel.

This invention is by no means limited to the embodiments given by way of example and shown in the figures, with such a method and device for expanding a fluid being able to be carried out in different variants without going beyond the scope of the invention.

The invention claimed is:

1. A device for expanding a fluid, which device (1), comprising:

an inlet (2) for a high pressure fluid;

an outlet (3) for a low pressure fluid;

a control valve (4) between the inlet (2) and outlet (3) for expanding the fluid to a predefined pressure level;

an expander (5) for expanding the fluid and connected in parallel with the control valve (4); and a controller (8) which is configured to control the expander (5) based on a flow rate (Qklep) of the fluid through the control valve (4).

2. The device according to claim 1, wherein the expander is of a type whose flow rate passing through them can be regulated.

3. The device according to claim 1, wherein the expander is of a type whose flow rate passing through them cannot be regulated.

4. A method for expanding a fluid by means of a device (1) comprising an inlet (2) for a high pressure fluid, an outlet (3) for a low pressure fluid, a control valve (4) between the inlet (2) and outlet (3) for expanding the fluid, and an expander (5) connected in parallel with the control valve (4), wherein the method comprises:

controlling a flow rate (Qklep) of the fluid passing through the control valve (4) such that a pressure at the outlet (3) is regulated at a predefined pressure level; and controlling a flow rate of the fluid passing through the expander (5) on the basis of the flow rate (Qklep) passing through the control valve (4).

5. The method according to claim 4, wherein the method further comprises the step of determining the flow rate (Qklep) through the control valve (4).

6. The method according to claim 5, wherein for determining the flow rate (Qklep) through the control valve (4) a position of the control valve (4) is used.

7. The method according to claim 4, wherein, in order to control the flow rate passing through the expander (5), the method comprises the following steps:

if the flow rate (Qklep) through the control valve (4) is equal to or greater than Qmin+Qdelta+Qi and the expander (5) is not switched on yet, switch on the expander (5) with flow rate Qi; and if the flow rate (Qklep) through the control valve (4) becomes less than Qmin and the expander (5) is not switched off yet, switch off the expander (5);

where:

Qmin is a maximum value of a total flow rate of fluid through the device (1) under which only fluid may flow through the control valve (4) and fluid may not flow through the expander (5);

Qdelta is a hysteresis value that is chosen in function of fluctuation in the total flow rate of the fluid such that the expander (5) is not constantly switched on and then off; and Qi is the flow rate that can flow through the expander (5).

8. The method according to claim 7, wherein an order in which the expander (5) is switched on and off is determined such that energy production is maximized and/or such that a number of running hours of the expander (5) is optimized.

9. The method according to claim 4, wherein, in order to control the flow rate passing through the expander (5), the method comprises the step of controlling the flow rate of the expander (5) according to a curve that represents an unambiguous relationship with the flow rate (Qklep) passing through the control valve (4).

10. The method in accordance with claim 9, wherein the curve is non-linear.

* * * * *